United States Patent [19]

Jordan

[11] 4,305,355

[45] Dec. 15, 1981

[54] CONTROL SYSTEM FOR VARIABLE DISPLACEMENT ENGINE

[75] Inventor: Paul T. Jordan, Jackson, Mich.

[73] Assignee: LPK, Inc., Presque Isle, Mich.

[21] Appl. No.: 60,243

[22] Filed: Jul. 25, 1979

[51] Int. Cl.[3] ..... F02B 77/00

[52] U.S. Cl. ..... 123/198 F; 123/90.11

[58] Field of Search ..... 123/90.11, 90.15, 90.16, 123/198 R, 198 DB, 198 F

[56] References Cited

U.S. PATENT DOCUMENTS

| | | | |
|---|---|---|---|
| 1,706,861 | 3/1929 | Pokorny | 123/198 R |
| 2,131,264 | 9/1938 | Benjamin | 123/198 R |
| 2,575,384 | 11/1951 | Horton | 123/198 R |
| 2,745,391 | 5/1956 | Winkler, Jr. | 123/90.16 |
| 4,146,006 | 3/1979 | Garabedian | 123/198 F |
| 4,227,505 | 10/1980 | Larson et al. | 123/198 F |

*Primary Examiner*—Craig R. Feinberg
*Assistant Examiner*—W. R. Wolfe
*Attorney, Agent, or Firm*—Reising, Ethington, Barnard, Perry & Brooks

[57] ABSTRACT

A control system (10) for a varible displacement internal combustion engine (12) is disclosed as including a sensor (14) for sensing intake manifold vacuum and a control unit (20) for operating valve deactuators (22*a, b, c,* and *d*) of the engine with a hysteretic action in response to the vacuum sensed so as to prevent oscillatory on-off operation of the valve deactuators. In its preferred construction, the control unit includes switches (28*a, b, c,* and *d*) for operating the valve deactuators and a switch operator (32, 34) including a lost motion connection that provides the hysteretic operation of the valve deactuators. The switch operator preferably includes rod (32) that is movable in response to the vacuum sensed and a switch operating member (34) slidably mounted on the rod and moved by stops (36, 38) to provide the lost motion connection. Electrical, fluid, and mechanical systems are all capable of operating valve deactuators by the hysteretic operation disclosed.

6 Claims, 6 Drawing Figures

CONTROL SYSTEM FOR VARIABLE DISPLACEMENT ENGINE

TECHNICAL FIELD

This invention relates to a control system for operating valve deactuators of a variable displacement internal combustion engine.

BACKGROUND ART

Variable displacement internal combustion engines are conventionally referred to as split engines and have heretofore incorporated valve deactuators for selectively deactuating selected cylinders during periods of low power demand. All of the cylinders are allowed to operate by the valve deactuators during periods of high power demand so as to provide the engine power output required. Operation of the valve deactuators in such a manner thus provides fuel efficiency without sacrificing performance.

Automatic operation of a variable displacement internal combustion engine requires a control system that is capable of sensing the engine power demand and properly operating the valve deactuators in response thereto so as to result in fuel economy without sacrificing performance. One such prior control system is disclosed by U.S. Pat. No. 4,173,209, entitled "ENGINE CONTROL SYSTEM AND VALVE DEACTUATOR THEREFOR," filed Dec. 16, 1977 by Edgar R. Jordan as a divisional of U.S. patent application Ser. No. 815,743, now U.S. Pat. No. 4,175,534, also entitled "ENGINE CONTROL SYSTEM AND VALVE DEACTUATOR THEREFOR" and filed by Edgar R. Jordan on July 14, 1977, both of which prior patents are hereby incorporated by reference. The control system disclosed by the aforementioned patents includes a first sensor for generating a variable signal responsive to engine throttle position and a second sensor for generating a variable signal responsive to engine output speed. A comparator of the system compares the two signals and generates a variable output signal for controlling the valve deactuators.

Heretofore it has not been possible to sense intake manifold vacuum to operate valve deactuators of a variable displacement internal combustion engine due to the effect that deactuation of each cylinder has on the manifold vacuum. Dropping out one cylinder as the manifold vacuum drawn exceeds a predetermined extent then decreases the vacuum below the predetermined extent so that the cylinder again operates and again increases the vacuum and so on such as to result in an unstable on-off oscillation of the valve deactuator and the associated cylinder. Such an oscillatory operation does not promote engine efficiency or smooth engine operation.

DISCLOSURE OF INVENTION

An object of the present invention is to provide an engine control system capable of operating solely in response to intake manifold vacuum to control valve deactuators of a variable displacement internal combustion engine while preventing oscillatory on-off operation of the valve deactuators.

In carrying out the above object and other objects of the invention, the engine control system disclosed includes a sensor that senses intake manifold vacuum of a variable displacement engine and also includes a control unit that operates valve deactuators of the engine with a hysteretic action in response to the vacuum sensed so as to prevent oscillatory on-off operation of the valve deactuators.

The preferred control unit disclosed includes switches for operating the valve deactuators and a switch operator for operating the switches in response to the vacuum sensed by the sensor. The switch operator includes a rod movable in response to the vacuum sensed and also includes a switch operating member that is slidably mounted on the rod by a lost motion connection in order to provide the hysteretic action that operates the switches and their associated valve deactuators. Stops on the rod control the extent of movement of the switch operating member along the rod so as to thereby control the degree of vacuum hysteresis that takes place during operation of the system. A retarder for preventing movement of the operating member with the rod prior to engagement thereof by one of the stops includes a spring that is preferably embodied by a leaf spring which frictionally engages the switch operating member to retard movement thereof with the control rod.

Smooth engine operation as one or more cylinders are actuated or deactuated can be achieved by sequentially operating the switches as the engine manifold vacuum increases or decreases. An adjustable mount for each switch controls the degree of vacuum at which the switch operating member provides operation of the switch and its associated valve deactuator. Also, at least one of the stops on the rod is adjustable to control the degree of hysteretic action that takes place.

Electrical, fluid, and mechanical control systems for a variable displacement internal combustion engine are all capable of utilizing a sensor and a control unit with the hysteretic action in order to prevent oscillatory on-off operation of valve deactuators of the engine.

The objects, features and advantages of the present invention are readily apparent from the following detailed description of the best mode for carrying out the invention when taken in connection with the accompanying drawings.

BEST MODE FOR CARRYING OUT THE INVENTION

Figure 1:
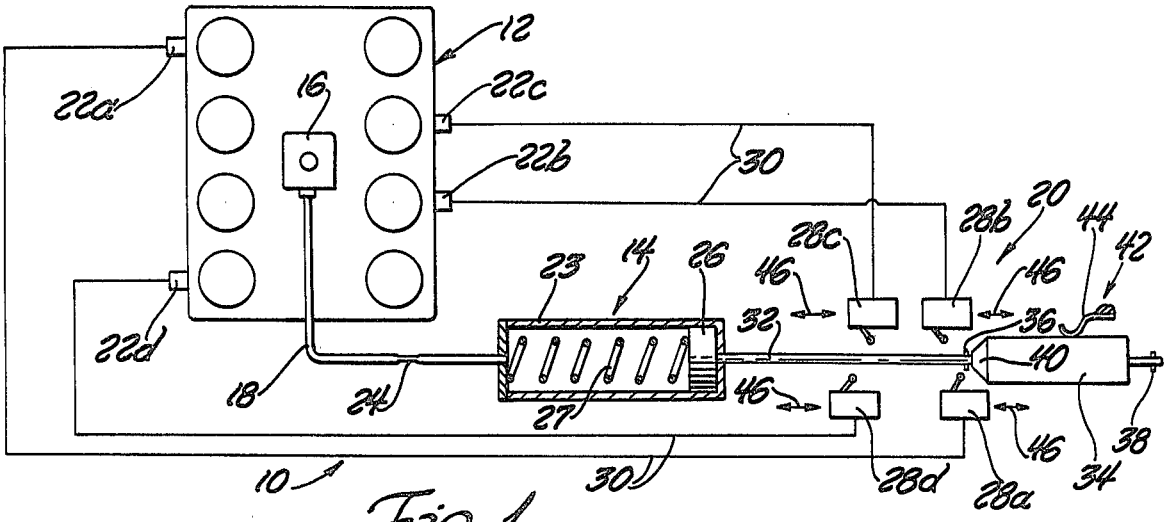
FIG. 1 is a schematic view illustrating an engine control system that is constructed according to the present invention to operate valve deactuators of a variable displacement internal combustion engine.

Referring to FIG. 1 of the drawings, an engine control system generally indicated by 10 controls valve deactuators of a variable displacement internal combustion engine 12 in a manner according to the invention as is hereinafter described. Control system 10 includes a sensor 14 for sensing a vacuum at the engine intake manifold 16 through a conduit 18 in order to provide a signal that indicates the power demand on the engine. The control system 10 also includes a control unit 20 for operating valve deactuators *22a, 22b, 22c,* and *22d* that are respectively associated with the intake and exhaust valves of the number 1, 6, 4, and 7 engine cylinders in order to control valve operation and the consequent operation of the cylinders. Control unit 20 operates in response to the vacuum sensed with a hysteretic action that prevents oscillatory on-off operation of the valve deactuators as a result of the vacuum change when any cylinder is added or dropped from operation.

Vacuum sensor 14 includes a housing 23 that is communicated with the conduit 18 through a restricted orifice 24 of the conduit 18. A piston 26 is movable to the left and the right in a sealed relationship within the housing 23 and is normally biased toward the right by a spring 27 within the housing. Movement of the sensor piston 26 toward the left against the bias of spring 27 as the intake manifold vacuum increases provides a signal to the control unit 20 in order to operate the valve deactuators *22a, b, c,* and *d* so as to terminate operation of their associated engine cylinders. Likewise, movement of the sensor piston 26 toward the right under the bias of spring 27 as the intake manifold vacuum decreases provides a signal to the control unit 20 in order to operate the valve deactuators *22a, b, c,* and *d* so as to commence operation of their associated engine cylinders. However, as previously mentioned, the control unit operates with a hysteretic action that prevents oscillatory on-off operation of the valve deactuators at any degree of vacuum as a result of the vacuum change that takes place as a cylinder is added or dropped. This hysteretic action allows the system to operate solely in response to the intake manifold vacuum although it may be desirable to have high or low speed overrides or a cutout during engine warmup etc.

Control unit 20 shown in FIG. 1 includes switches *28a, b, c,* and *d* that are respectively connected to the valve deactuators *22a, b, c,* and *d* by associated connections 30 in order to provide operation of the valve deactuators. A control member or rod 32 of control unit 20 has one end which is fixed to the piston 26 of the vacuum sensor 14 and has another end which slidably supports a switch operating member 34 located between spaced rod stops 36 and 38 that cooperate to provide a lost motion connection that results in the hysteretic action which prevents on-off operation of the valve deactuators. A surface 40 on the left end of the switch operating member 34 actuates trip members of the switches *28a, b, c,* and *d* in order to trip and untrip the switches so as to thereby operate the valve deactuators *22a, b, c,* and *d.* A retarder 42 of the control unit includes a leaf spring 44 that frictionally engages the switch operating member 34 to prevent movement thereof in response to movement of control rod 32 until stop 38 engages the right end of the switch operating member or stop 36 engages its left end.

Movement of the switch operating member 34 toward the left from the FIG. 1 position is provided by the stop 38 after the rod 32 has moved in response to an increased manifold vacuum an extent equal to the lost motion permitted by the connection of the switch operating member on the rod. After the switch operating member 34 has tripped the trip member of any one of the switches *28a, b, c,* or *d,* the decrease in vacuum as a result of the accompanying deactuation of the associated engine cylinder does not untrip the switch because the corresponding movement of the rod 32 to the right is not great enough as a result of the vacuum decrease to engage the stop 36 with the left end of the switch operating member. Likewise, subsequent movement of the switch operating member to the right is provided by the stop 36 after rod 32 has moved in response to a decreased manifold vacuum an extent equal to the lost motion permitted between the stops. After the switch operating member 34 has untripped the trip member of any one of the switches *28a, b, c,* or *d,* the increase in manifold vacuum as a result of the accompanying actuation of the associated engine cylinder does not untrip the switch because the corresponding movement of the rod 32 to the left is not great enough as a result of the vacuum increase to engage the stop 38 with the right end of the switch operating member. Thus, there is not oscillatory on-off operation of the cylinders upon either actuation or deactuation thereof by the control unit in response to the vacuum sensed.

The engine control system illustrated in FIG. 1 has the switches *28a, b, c,* and *d* mounted in a spaced relationship along the length of the rod 32 so that the deactuation and actuation of the cylinders is provided in a sequential manner as the extent of intake manifold vacuum increases. As such, the number 1, 6, 4, and 7 cylinders of the engine are successively deactuated in order to provide a smooth transition from eight cylinders to four cylinders when operation with this smaller number of cylinders is possible without sacrificing performance. Likewise, the number 7, 4, 6, and 1 cylinders are sequentially actuated to provide a smooth transition from four cylinders to eight cylinders when operation with this larger number of cylinders is required to provide the engine power output necessary.

It should also be noted that each of the switches *28a, b, c,* and *d* is adjustably mounted along the length of the control rod 32 as shown by arrows 46 so as to permit adjustment of the point of vacuum at which each particular cylinder is dropped out.

Figure 2:
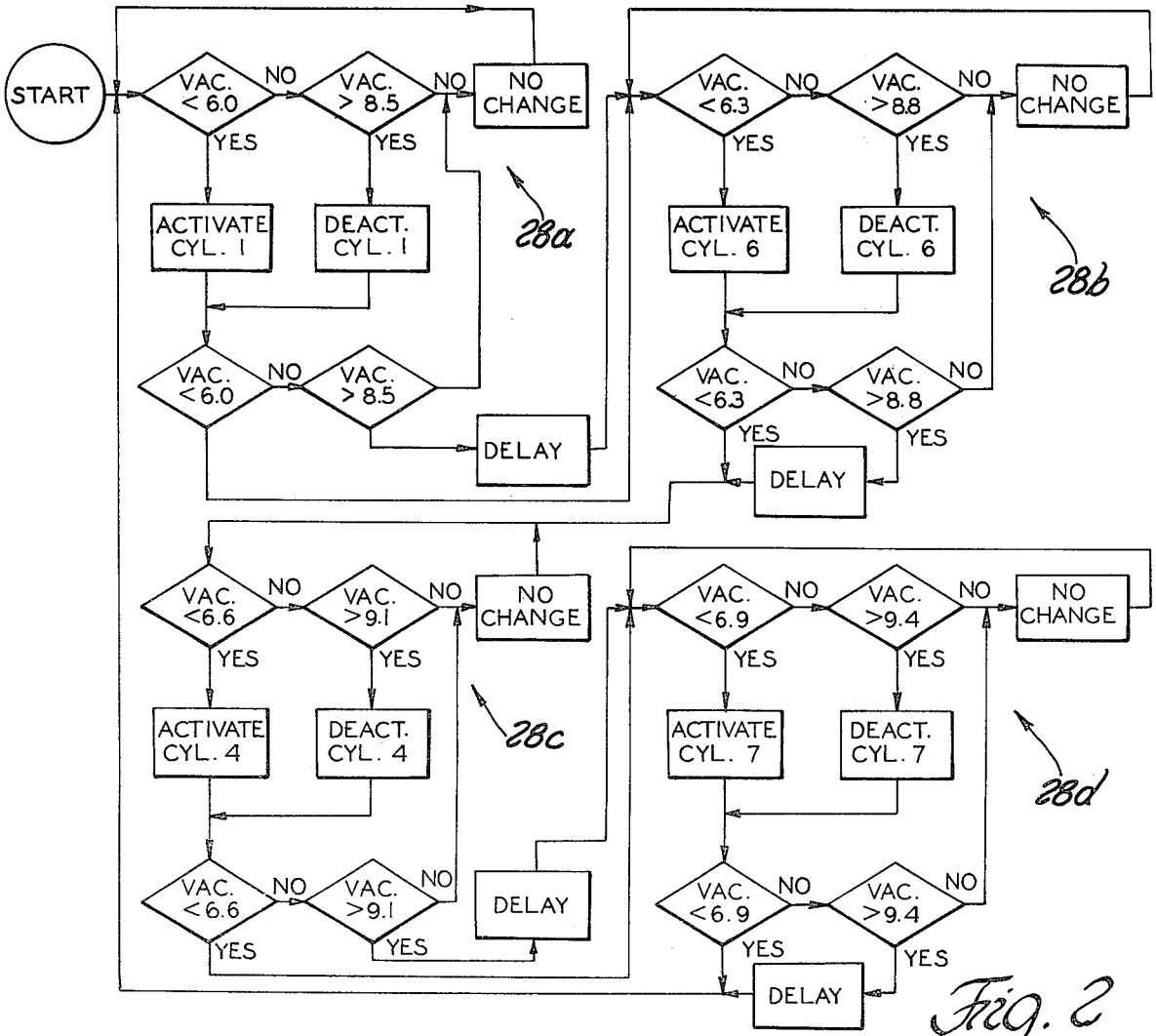
FIG. 2 is a logic flow diagram illustrating the operation of the control system shown in FIG. 1.

With reference to FIG. 2, the manner in which the switches *28a, b, c,* and *d* control operation of the cylinders shown by the schematic flow diagram wherein numbers indicated within the diamond shaped boxes represent the vacuum sensed in inches of mercury as being less than (<) or greater than (>) the numerical limits shown. From the start position, switch *28a* is operable to actuate cylinder number 1 whenever the intake manifold vacuum is less than 6.0 inches of mercury and to deactuate this cylinder whenever the vacuum is greater than 8.5 inches of mercury. Likewise, switch *28b* actuates cylinder number 6 whenever the intake manifold vacuum is less than 6.3 inches of mercury and deactuates this cylinder whenever the vacuum is greater than 8.8 inches of mercury. Switch *28c* similarly actuates cylinder number 4 when the intake manifold vacuum is less than 6.6 inches of mercury and deactuates this cylinder when the vacuum is greater than 9.1 inches of mercury; and switch *28d* in a like manner actuates cylinder number 7 when the intake manifold vacuum is less than 6.9 inches of mercury and deactuates this cylinder when the vacuum is greater than 9.4 inches of mercury. The restricted orifice 24 illustrated in FIG. 1 provides the delay illustrated in FIG. 2 between each switch operation when high vacuum conditions exist so as to prevent sudden deactuation of all four cylinders that could provide roughness in operation. For each switch, the difference of 2.5 inches of mercury that represents the limits between actuation and deactuation of the associated cylinder corresponds to the lost motion permitted by the switch operating member 34 on the control rod 32 between the limits of stops 36 and 38.

A preferred construction of the vacuum sensor 14 and the control unit 20 is illustrated in FIGS. 3 through 6. The housing 23 of the sensor 14 shown in FIG. 3 includes a cup-shaped member 48 as well as a cap 50 that is secured to member 48 by bolts 52. A diaphragm 54 is clamped between the housing member 48 and its cap 50 upon assembly and is also clamped between the piston 26 and a plate 56 by a nut 57 which is received by a thread portion 36 of the rod 32. The right end of the thread portion 36 also provides the rod stop that engages the left end of the switch operating member 34. An end 58 of the rod 32 is located on the opposite side of the piston 26 as the thread portion stop 36 and is slidably received within a hole 59 in the housing member 48 in order to guide the piston during movement to the left and the right. Springs 27 that bias the piston 26 to the right are adjustably engaged with the left side of the piston 26 by positioners 60 including threaded studs and lock nuts on the housing member 48. On the right side of piston 26, the control rod 32 has a threaded end on which a pair of stop nuts 38 are adjustably positioned in a locked relationship with each other so as to provide the stop which engages the right end of the switch operating member 34.

Figure 3:
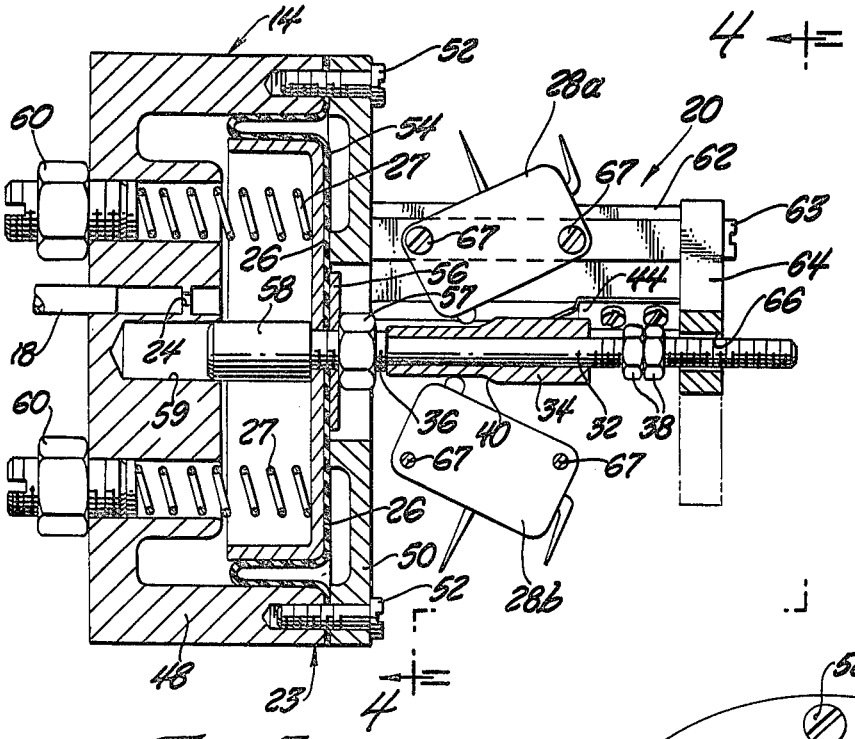
FIG. 3 is a sectional view illustrating a preferred construction of a vacuum sensor and a control unit of the schematically indicated control system shown in FIG. 1.
Figure 4:
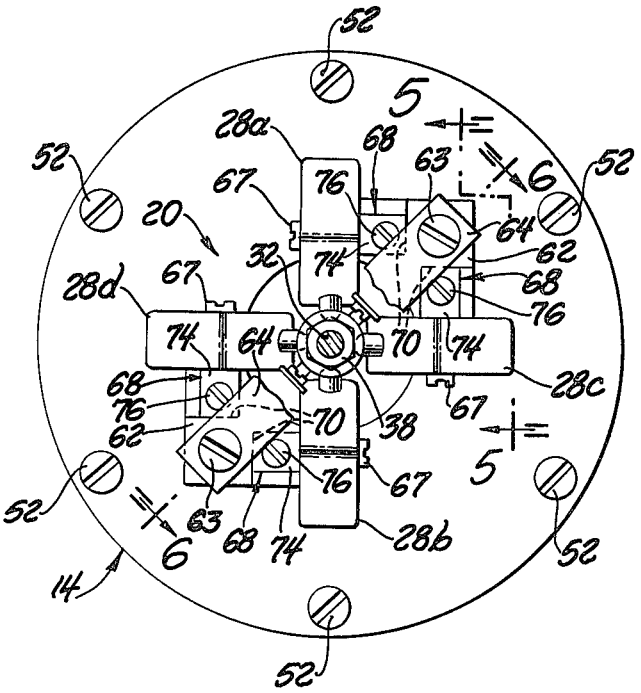
FIG. 4 is a view of the control unit taken along line 4—4 of FIG. 3.

As seen by combined reference to FIGS. 3 and 4, the switches 28*a, b, c,* and *d* that operate the valve deactuators are mounted on a pair of supports 62 that are secured by bolts 63 to the housing cap 50 and to the opposite ends of a connector 64. A central opening 66 (FIG. 3) of the connector 64 receives the control rod 32 which moves within the opening to the left and right. Each support 62 mounts a pair of the switches 28*a, b, c,* and *d* so that the switches are spaced in a circumferential relationship about the elongated axis of the control rod 32 at 90 degree intervals. Surface 40 of the switch operating member 34 thus is engageable with the trip members of the switches in order to provide switch operations that controls the associated valve deactuators through electrical signals.

Figure 5:
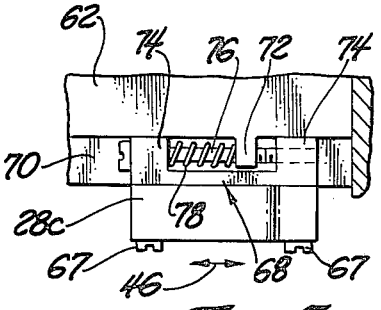
FIG. 5 is a view taken along line 5—5 of FIG. 4 and illustrates the manner in which switches of the control unit are provided with adjustable mounts to control operation thereof.

As illustrated by the switch 28*c* shown in FIG. 5, each switch is secured by bolts 67 to an adjustable mount 68 which is positioned along a slideway 70 defined on the associated suport 62 by perpendicular surfaces. A lug 72 of the support 62 is positioned between end lugs 74 of the mount 68. Bolt 76 extends between one of the end lugs 74 on the mount 68 and the lug 72 on the support 62 as does a helical spring 78 that encircles the bolt. A threaded hole in the lug 72 receives the bolt 76 as do unthreaded holes in the end lugs 74. Adjustment of the bolt 76 moves the switch mount 68 to the left and to the right and thereby adjusts the location at which the switch operating member 34 illustrated in FIG. 3 provides operation of the switch trip member. Spring 78 of the adjustable mount shown in FIG. 5 prevents vibration from moving the switch from any adjusted position by exerting a pressure between the support lug 72 and the mount lug 74 engaged by the head of bolt 76.

Figure 6:
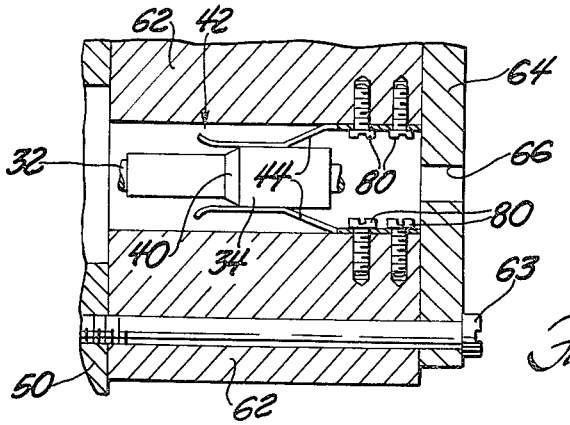
FIG. 6 is a sectional view taken generally along line 6—6 of FIG. 4 and illustrates spring retarders that are utilized to control movement of a switch operating member of the control unit.

As seen in FIG. 6, the retarder 42 includes a pair of the leaf springs 44 that slidably engage the switch operating member 34 to the right of its operating surface 40 in order to provide friction that prevents movement thereof along the control rod 32 except upon engagement of the ends thereof by the stops 36 and 38 illustrated in FIG. 3. Each retarder spring 44 illustrated in FIG. 6 is secured to the associated support 62 by a pair of bolts 80 in a mounted relationship so that the free end of the springs can provide the frictional engagement that retards the movement of the switch operating member.

It should be understood that the control unit can use vacuum switches or mechanical connections instead of the electrical switches illustrated and still provide the hysteretic action upon operating the valve deactuators. Also, more than one cylinder can be added or dropped at any extent of vacuum so long as the system has sufficient hysteresis to prevent on-off operation with the greater vacuum change that results by adding or dropping more than one cylinder. A rotatable switch operating member can also be used for sequentially operating the cylinders in different orders. Since most operation for an eight cylinder engine will be in four or five cylinders, different ordering of the switch operation evens the use and consequent life of both the switches and the associated valve deactuators.

While the best mode for carrying out the invention has herein been described in detail, those familiar with the art to which this invention relates will recognize various alternative designs and embodiments for practicing the invention as defined by the following claims.

What is claimed is:

1. In an internal combustion engine including a plurality of cylinders each of which includes intake and exhaust valves and an associated valve deactuator whose operation controls operation of the associated intake and exhaust valves and thereby also affects engine intake manifold vacuum, a control system for the valve deactuators comprising: a sensor for sensing intake manifold vacuum of the engine; a control unit for operating the engine valve deactuators with a hysteretic action in response to the vacuum sensed by the sensor so as to prevent oscillatory on-off operation of the valve deactuators; the control unit including electrical switches for providing an electrical signal that operates the valve deactuators; the control unit also including a switch operator for operating the switches in response to the vacuum sensed by the sensor; the switch operator including a lost motion connection for providing the hysteretic action that prevents oscillatory on-off operation of the valve deactuators; the switch operator also including a rod movable in response to the vacuum sensed and a switch operating member that is mounted by the lost motion connection on the rod so as to operate the switches in a sequential manner as the vacuum increases; the rod including stops for moving the switch operating member; a retarder for preventing movement of the operating member with the rod prior to engagement thereof by one of the stops; and wherein the retarder comprises a spring that frictionally engages the switch operating member.

2. In an internal combustion engine including a plurality of cylinders each of which includes intake and exhaust valves and an associated valve deactuator whose operation controls operation of the associated intake and exhaust valves and thereby also affects engine intake manifold vacuum, a control system for the valve deactuators comprising: a sensor for sensing intake manifold vacuum of the engine; a control unit for operating the engine valve deactuators with a hysteretic action in response to the vacuum sensed by the sensor so as to prevent oscillatory on-off operation of the valve deactuators; the control unit including electrical switches for providing an electrical signal that operates the valve deactuators; the control unit also including a switch operator for operating the switches in response to the vacuum sensed by the sensor; the switch operator including a lost motion connection for providing the hysteretic action that prevents oscillatory on-off operation of the valve deactuators; the switch operator also including a rod movable in response to the vacuum sensed and a switch operating member that is mounted by the lost motion connection on the rod so as to operate the switches in a sequential manner as the vacuum increases; and wherein each switch includes an adjustable mount for controlling the degree of vacuum at which the operating member provides operation of each switch.

3. In an internal combustion engine including a plurality of cylinders each of which includes intake and exhaust valves and an associated valve deactuator whose operation controls operation of the associated intake and exhaust valves and thereby also affects engine intake manifold vacuum, an engine valve deactuator control unit comprising: switches for operating the engine valve deactuators; an operator including a control member movable in response to engine intake manifold vacuum; the operator also including a switch operating member for actuating the switches in a sequential order; a lost motion connection between the control member and the switch operating member; and the control member including stops that limit the movement of the switch operating member with respect thereto such that the switch operation takes place sequentially with a hysteretic action so as to prevent oscillatory on-off operation of the valve deactuators.

4. A control system for valve deactuators of a variable displacement internal combustion engine, the control system comprising: a sensor for sensing intake manifold vacuum of the engine; a control unit including switches for operating the engine valve deactuators; the control unit also including a switch operator for operating the switches; said switch operator including a rod movable in response to the degree of vacuum sensed by the sensor; the switch operator also including a switch operating member slidably supported on the rod; and stops on the rod for engaging the switch operating member upon rod movement in order to provide a lost motion connection and switch operation with a hysteretic action in response to the vacuum sensed by the sensor so as to prevent oscillatory on-off operation of the valve deactuators.

5. A control system for valve deactuators of a variable displacement internal combustion engine, the control system comprising: a sensor for sensing intake manifold vacuum of the engine; a control unit including switches for operating the engine valve deactuators; the control unit also including a switch operator for operating the switches; said switch operator including a rod movable in response to the degree of vacuum sensed by the sensor; the switch operator also including a switch operating member slidably supported on the rod; stops on the rod for engaging the switch operating member upon rod movement in order to provide a lost motion connection and switch operation with a hysteretic action in response to the vacuum sensed by the sensor so as to prevent oscillatory on-off operation of the valve deactuators; one of the stops being adjustable so as to control the degree of hysteretic action; and a retarder that prevents movement of the switch operating member prior to engagement thereof by either stop on the rod.

6. A control system as in claim 5 wherein the retarder includes a leaf spring that frictionally engages the switch operating member to retard the movement thereof along with the rod prior to engagement thereof by one of the stops.

* * * * *